US011441200B2

(12) United States Patent
An et al.

(10) Patent No.: US 11,441,200 B2
(45) Date of Patent: Sep. 13, 2022

(54) METHOD AND DEVICE FOR PREPARING CORROSION-RESISTANT HOT STAMPING PART

(71) Applicant: Suzhou Pressler Advanced Forming Technologies Co., Ltd., Kunshan (CN)

(72) Inventors: Jian An, Kunshan (CN); Hanjie Chen, Kunshan (CN); Dongcheng Li, Kunshan (CN)

(73) Assignee: Suzhou Pressler Advanced Forming Technologies Co., Ltd., Kunshan (CN)

( * ) Notice: Subject to any disclaimer, the term of this patent is extended or adjusted under 35 U.S.C. 154(b) by 0 days.

(21) Appl. No.: 17/241,714

(22) Filed: Apr. 27, 2021

(65) Prior Publication Data

US 2021/0254189 A1 Aug. 19, 2021

Related U.S. Application Data

(63) Continuation of application No. PCT/CN2019/078414, filed on Mar. 18, 2019.

(30) Foreign Application Priority Data

Dec. 6, 2018 (CN) ..... 201811485903.8
Feb. 25, 2019 (CN) ..... 201910138561.1

(51) Int. Cl.
*C21D 8/02* (2006.01)
*B21D 22/02* (2006.01)
(Continued)

(52) U.S. Cl.
CPC ..... *C21D 8/0247* (2013.01); *B21D 22/02* (2013.01); *B21D 37/01* (2013.01); *B21D 37/16* (2013.01);
(Continued)

(58) Field of Classification Search
None
See application file for complete search history.

(56) References Cited

U.S. PATENT DOCUMENTS 8,722,203 B2 5/2014 Laurent et al.
2006/0219334 A1* 10/2006 Brodt ..... B21D 35/00 148/647
(Continued)

FOREIGN PATENT DOCUMENTS

CN 101631880 A 1/2010
CN 104384283 A 3/2015
(Continued)

OTHER PUBLICATIONS

Yelton et al. "Electroplated Coatings for Friction, Lubrication, and Wear Technology." ASM Handbook, vol. 18, Friction, Lubrication, and Wear Technology. 2017. (Year: 2017).*
(Continued)

*Primary Examiner* — Brian D Walck
(74) *Attorney, Agent, or Firm* — Schwegman Lundberg & Woessner, P.A.

(57) ABSTRACT

Disclosed is a method for manufacturing a corrosion-resistant hot-stamping part and a device thereof. The method includes the following steps: blanking a bare steel plate into a required blank shape; heating the blank to above AC3 in an oxygen-free heating furnace to austenite the blank; putting the austenitized blank into a mold to mold a part; and conducting a surface treatment of the part to form a corrosion-resistant coating layer on a surface of the part. The hot-stamping part manufactured using the described method has good surface quality and great corrosion-resistant performance

13 Claims, 4 Drawing Sheets

(51) Int. Cl.

| | |
|---|---|
| ***B21D 37/01*** | (2006.01) |
| ***B21D 37/16*** | (2006.01) |
| ***C22C 18/04*** | (2006.01) |
| ***C23C 30/00*** | (2006.01) |
| ***C25D 3/56*** | (2006.01) |
| ***C25F 1/08*** | (2006.01) |

(52) U.S. Cl.
CPC ..... *C22C 18/04* (2013.01); *C23C 30/005* (2013.01); *C25D 3/565* (2013.01); *C25F 1/08* (2013.01); *C21D 2211/001* (2013.01)

(56) References Cited

U.S. PATENT DOCUMENTS

| | | | | |
|---|---|---|---|---|
| 2010/0150772 | A1* | 6/2010 | Siller | C22C 38/44 420/84 |
| 2010/0221572 | A1 | 9/2010 | Laurent et al. | |
| 2018/0237878 | A1 | 8/2018 | Wang et al. | |

FOREIGN PATENT DOCUMENTS

| | | | |
|---|---|---|---|
| CN | 104831020 | A | 8/2015 |
| CN | 106282878 | A | 1/2017 |
| CN | 106811783 | A | 6/2017 |
| CN | 107127238 | A | 9/2017 |
| CN | 108505056 | A | 9/2018 |
| CN | 109433959 | A | 3/2019 |
| CN | 109433960 | A | 3/2019 |
| JP | 6191420 | B2 | 9/2017 |
| WO | WO-2020113844 | A1 | 6/2020 |

OTHER PUBLICATIONS

Fradette et al. "Vacuum Heat Treating Processes." ASM Handbook, vol. 4B, Steel Heat Treating Technologies. pp. 182-196. 2014. (Year: 2014).*

"Chinese Application No. 201910138561.0, First Office Action dated Sep. 30, 2019", (dated Sep. 30, 2019), 11 pgs.

"Chinese Application No. 201910138561.0, Notification to Grant Patent Right for Invention dated May 19, 2020", (dated May 19, 2020), 3 pgs.

"International Application No. PCT/CN2019/078414, International Search Report dated Jun. 21, 2019", (dated Jun. 21, 2019), 11 pgs.

* cited by examiner

METHOD AND DEVICE FOR PREPARING CORROSION-RESISTANT HOT STAMPING PART

CROSS-REFERENCE TO RELATED APPLICATIONS

This application is a continuation of International Application No. PCT/CN2019/078414 filed Mar. 18, 2019, which claims the benefit of priority to Chinese Application No. 201811485903.8, filed Dec. 6, 2018, entitled "Method for manufacturing a corrosion-resistant hot-stamping part and device thereof," and Chinese Application No. 201910138561.0, filed Feb. 25, 2019, entitled "A method for manufacturing corrosion-resistant hot-stamping part and device thereof," the benefit of priority of each of which is claimed herein and which applications are hereby incorporated by reference herein in their entirety.

TECHNICAL FIELD

The invention relates to the technical field of hot-stamping forming, in particular to a method for manufacturing a corrosion-resistant hot-stamping part and a device thereof.

TECHNOLOGY BACKGROUND

At present, in the process of car service, a hot-stamping part improves its corrosion-resistance by a coating treatment, however, once the coating layer is damaged, a corrosion under the coating is easy to occur, further resulting in flaking the coating layer. On the other hand, the cut place of the hot-stamping part and the fastening place with other part also easy to get corrosion due to insufficient or non-uniform thickness of the coating during coating.

In order to solve the above problems, galvanized 22MnB5 or Al—Si coated 22 MnB5 steel plate are used for hot forming instead of uncoated plate (also known as bare steel plate). Due to the surface of the galvanized steel plate contains Zn—Al coating or Zn—Fe—Al coating, these two kinds of coating is also called the Zn-base coating. Zinc base coating can provide activity or cathodic anti-corrosion protection to steel, ensuring no white rust (coating rust) appear at the steel in the corrosive environment for 72 hours or even 96 hours d, and the time to occur red rust (steel rust) is longer; Al—Si coating can also provide ani-corrosion protection barrier for steel, therefore, the hot-stamping part made of galvanized steel plate or Al—Si coated steel plate after painting process has dual corrosion-resistant ability However, in the process of hot-stamping, the steel plate blank needs to be heated at high temperature firstly, and then to be putted into a mold to be molded. In the process of being heated to the high temperature state, the galvanized steel plate or Al—Si coated steel will have some problems. Specifically, for the galvanized steel plated, first of all, zinc is easy to liquefied due to its low melting point and the liquid zinc can be broken because of the metal embrittlement fracture; Secondly, in the heating process, evaporation and oxidation of zinc in coating layer will decrease the zinc content and poor adhesion properties of oxides will affect the painting performance of the hot-stamping part.

To solve the problem of liquid metal embrittlement in the high temperature, patent application CN107127238A disclosed a hot-stamping forming method for zinc plating steel plate or steel strip, including the following steps: (1)producing a steel plate or a steel strip for hot-stamping forming, and conducting a zinc or Zn—Fe coating on the steel plate or steel strip; (2) heating: placing the steel plate or steel strip in continuous annealing furnace, heating the steel plate or steal strip at a speed greater than 5° C./s to a temperature higher than the temperature of the AC3, and holding the temperature for a holding time, making the steel plate or steel strip austenitized uniformly; (3) pre-cooling: after the steel plate or steel strip out of the furnace, conducting pre-cooling immediately, cooling to 650° C.~700° C.; (4) blanking: at a temperature of 650° C.~700° C., cutting the steel plate or steel strip according to the hot-stamping part shape and size; (5) hot-stamping forming and in-mold quenching: rapidly moving the steel plate or strip to the hot-stamping mold for stamping forming and quenching, forming temperature range is 400~650° C.; after hot-stamping forming is completed, cooling the blank in the mold, a martensite phase transformation is finished after cooling to room temperature in the mold or removed from the mold. Because the deformation resistance of the galvanized plate is large at the temperature between 400° C. to 650° C. during the warm forming, its formability performance is not good as forming under high temperature, therefore, galvanized steel plate for warm forming has poor mechanical properties and easy to crack during hot forming process; In addition, due to the low melting point of zinc, heating galvanized plate with greater than 5° C./s speed can easily cause the zinc layer liquefaction and volatilization, and influencing the painting performance of the hot-stamping part.

To solve the zinc layer volatilization in heating process problem, patent JP 6191420 discloses a hot-stamping steel production method and hot-stamping steel material, to be specific, the process is to make a high melting point dense layer on the galvanized layer by hot-plating or electroplating. The dense layer can avoid oxidation and improve corrosion-resistant performance. But this layer has low phosphating performance, which means it cannot react with zinc phosphate and manganese phosphate, which makes it difficult for the vehicle electrophoresis treatment of the body in white.

Moreover, although the evaporation of zinc layer can be prevented by the dense layer with high melting point on the surface, it cannot solve the problem that liquid zinc is easy to liquefy at high temperature. Therefore, the phenomenon of liquid metal embrittlement still exists in the hot-stamping process Patent application CN 106282878A discloses a manufacturing method of galvanized high-strength warm forming medium manganese steel piece, it introduces a kind of onsite hot galvanizing and then warm forming method, the specific method is as follows: Firstly put the medium manganese steel in the vacuum furnace and heat to 750° C.-850° C. for austenitizing, cool it in the cooling cavity full with protective gas to 500° C., then put the heated blank in a constant-temperature zinc tank at a temperature of 480° C.-500° C. for hot galvanizing, and finally dry and put the blank into mold for warm forming. This method is to use medium manganese steel for hot galvanizing then conduct warm forming process. Its purpose is to combine the heating for hot galvanizing and the heating for warm forming as one-time heating, which can save energy and to avoid zinc layer melting. But this process has disadvantages like, difficult to operation in practice for special shape blank, will cause quality unstable; Besides, for 22MnB5 blank forming under 500° C., this method doesn't generate high proportion of martensite structure, and it make plate performance much less than forming over 650° C. Because the martensite phase shift Ms points are above 420° C. usually, not suitable for the temperature range of 480° C.-500° C. in warm/hot-stamping forming.

For Al—Si coated steel plate, during the process of heating to AC3 (the end temperature of the ferrite transformed into austenite), the inter diffusion of Al—Si layer and steel base material in Al—Si coated steel plate generate Al—Si—Fe alloy, the corrosion potential of Al—Si—Fe alloy is basically the same with the corrosion potential of steel base material. Therefore, the corrosion-resistance of Al—Si coated steel is greatly reduced.

In addition, galvanized steel or Al—Si coated steel after hot-stamping, coating layer will appear different degrees of cracks, and when the crack is severe, it goes deep into the steel base material. Mostly, because the blank and coating layer are in a state of high temperature soften during coated steel hot-stamping process, friction cannot be avoided between the blank and mold surface, and softening coating is easily removed by friction. Therefore, coated steel after hot-stamping also lose the original corrosion-resistance ability. And when laser tailor-welding coated plate, it's typically required remove the coating layer near the welding joint which is good for welding. But after welding, welding joint area is without coating protection, the corrosion-resistant ability of the welding joint is bad.

The existing heating furnace for hot-stamping is typically an oxygen furnace (also called atmosphere furnace)usually use nitrogen gas as protective atmosphere, with the oxygen content generally required to be controlled below 0.5%. In the process of hot forming, the blank heating time is 3-4 min generally, then proceed furnace opening, and feeding and delivering after heating is completed. In the process of opening door, oxygen gets into the atmosphere furnace, resulting in a great increase in oxygen content, therefore, a large amount of nitrogen is needed to remove oxygen. In the actual production process, normally only control the oxygen content in furnace atmosphere at about 2%, so the general atmosphere furnace is difficult to prevent oxidation.

To sum up, the existing hot-stamping process and the hot-stamping part has the following problems:

1. a large amount of oxide skins appears on the bare steel plate when heating, which damage the mold surface during forming process, and then damage the part surface quality, which affect the service life of the mold.

2. shot blasting for hot-stamped bare steel plate is easily results in part deformation.

3. coated plate melting in the heating furnace is easy pollute the support device, such as furnace roller, damaging the support device, such as furnace roller surface nodules and ceramic roll breakage.

4. the coating layer of the coated plate is easy to get melt and softened during heating process, the coating layer and mold rub during forming, and a large number of adhesive material which is easy to cause scratches on the surface of a part is formed at the mold surface.

5. after the plating plate is heated and then formed into a part, the coating layer is severe damaged, leading to corrosion-resistance far less than the original plate.

6. to avoid the liquefaction of Al—Si coating, Al—Si coating plate needs to be heated at a slow speed of 500° C. to 700° C., extending the heating time and influencing the production efficiency.

7. to avoid the production of liquid zinc, the galvanized blank in direct thermoforming uses a low temperature forming which causes the temperature window that is too narrow (forming temperature too close to the starting temperature of martensite phase transformation, zinc melting point is nearly the same as the Ms point temperature of 22 Mnb5), the mechanical properties in actual production is not stable.

8. in the laser tailor-welding process for coating plate, it's typically required to remove the coating layer near the welding joint, but after welding, the weld joint area is without coating protection, corrosion-resistant ability of welding joint area is bad.

BRIEF SUMMARY OF THE INVENTION

In order to overcome the defect of existing technology, the embodiment of present invention provides a method for manufacturing corrosion-resistant hot-stamping part and a device thereof. It's used to solve at least one of above problems.

An embodiment of this application discloses: a method for manufacturing a corrosion-resistant hot-stamping part, including the following steps:

blanking a bare steel plate into a required blank shape;

heating the blank to above AC3 in an oxygen-free heating furnace to austenize the blank;

putting the austenitized blank into a mold to mold a part; and conducting a surface treatment of the part to form a corrosion-resistant coating layer on a surface of the part.

Specifically, after the step "conducting a surface treatment of the part to form a corrosion-resistant coating layer on a surface of the part", the part is further subjected to a dehydrogenation treatment.

Specifically, the dehydrogenation treatment comprises heating the part to 140° C.-200° C. and insulating the part at the temperature for 10-30 min.

Specifically, the oxygen-free heating furnace is an inert gas protection furnace or a vacuum heating furnace.

Specifically, a vacuum degree of the vacuum heating furnace is 0.1-500 Pa.

Specifically, the vacuum degree of the vacuum heating furnace is 0.1-100 Pa.

Specifically, a time for heating the part and a time for insulating the part by the oxygen-free heating furnace is 60-300 s in total.

Specifically, the blank in the oxygen-free heating furnace is heated to 880° C.-950° C.

Specifically, a time for transferring the blank after heating from the oxygen-free heating furnace to the mold is 5-10 s.

Specifically, a temperature for the blank in the mold starting to be molded is 650° C.-850° C.

Specifically, the mold has a water cooling system, and the water cooling system makes the blank cooling at a speed of not less than 30° C./s during the molding.

Specifically, the corrosion-resistance coating layer includes a Zn coating, a Zn—Fe alloy coating, a Zn—Al alloy coating, or a Zn—Ni alloy coating.

Specifically, in the step "conducting a surface treatment of the part to form a corrosion-resistant coating layer on a surface of the part", the surface treatment includes an electroplating.

Specifically, the surface treatment also includes ultrasonic cleaning and pickling before coating.

Specifically, a time for pickling the part is 5 s-15 s.

Specifically, in the step "conducting a surface treatment of the part to form a corrosion-resistant coating layer on a surface of the part", firstly using a current density of 5-10 $A/dm^2$ for 0.5-2 min to strike plating the part, then using a current density of 1-3 $A/dm^2$ for 1-15 min to electroplating the part.

Specifically, in the step "conducting a surface treatment of the part to form a corrosion-resistant coating layer on a surface of the part", an auxiliary anodizing or a pictographic anodizing is used when electroplating.

Specifically, between the step "putting the austenitized blank into a mold to mold a part" and the step "conducting a surface treatment of the part to form a corrosion-resistant coating layer on a surface of the part", further includes laser trimming or hole-cutting the part.

An embodiment of this application also discloses a device for manufacturing the corrosion-resistant hot-stamping part, using the manufacturing method described above, the device include a blanking mechanism, a heating mechanism, a molding mechanism and a surface treatment mechanism;

specifically, the blanking mechanism is used to blank the bare steel plate into the required blank shape;

the heating mechanism is used to heat the blank after blanking;

the forming mechanism is used to mold the blank after the heating into a part;

the surface treatment mechanism is used to conduct the surface treatment of the part to form the corrosion-resistant coating layer on the surface of the part.

Compared to existing technology, this invention has the following advantages:

1. Since the blank made of bare steel plates is heated and molded, it does not need to be considered that the heating speed on the alloying and melting of the coating layer of the blank (bare steel plate). Therefore, it's feasible to heat the blank rapidly with heating speed of 20° C./s-50° C./s. For the conventional method, to avoid the alloying and melting of Al coated plate, the coating plate can be heated only at a speed of 7-10° C./s usually. Therefore, the method in this invention can shorten the blank heating time by about 60-120 s, thereby improving production efficiency. In addition, the surface of the blank is not damaged due to the fact that the surface of the blank is free of melt, and the surface of the formed part is not scratched.

2. The blank is heated to a high temperature in an oxygen-free environment and is not oxidized during the heating process, the blank is subjected to trace oxidation only in the process of transferring from the heating furnace to the mold. The thickness of the oxide layer on the surface of the blank is on the order of nanometers, and the thickness of the oxide layer on the surface of the blank is as high as 30-100 μm under conventional aerobic heating. Compared with the traditional heating and oxidizing, the degree of oxidation of the blank in this embodiment can be almost negligible, and therefore, the shot blasting process is not needed, and the problems of part deformation and the like caused by shot blasting are avoided.

3. With the adoption of the scheme, heating the bare steel plate and molding it to be a part firstly, then doing surface treatment for a corrosion-resistant coating layer. And due to the coating of the part is without heating, the compactness of the coating structure is not affected, the smooth compactness is kept, and its structure and composition is not changed. Therefore, its corrosion-resistant performance is not affected and is excellent.

4. The part that manufactured using the method of this embodiment will go through trimming or hole cutting before coating process, so the trimming and holes cutting area at the part will be coated. Therefore, trimming and holes cutting area will have excellent corrosion-resistant performance.

5. A Low hydrogen embrittlement coating process (before electroplating, use low-concentration acid solution to acid pickling on the part for a short time; when electroplating, conduct acid electroplating process, the efficiency of cathodic current is high and the hydrogen evolution less; In addition, during electroplating, firstly a large current is used for short-time stamping, so that the surface of the part forms a dense layer, electroplating time is reduced, hydrogen enters the part matrix is less) and dehydrogen treatment is used, the risk of hydrogen embrittlement of part is greatly reduced.

For above and other purposes, characteristics and advantages of this invention can be clearer and easy to understand. The following cases are some embodiments with enclosed illustration, as details below.

BRIEF DESCRIPTION OF THE DRAWINGS

In order to better explain the technical method in this invention or existing technology, the figures for embodiments or existing technology is introduced as following. The described figures below are only some embodiments in this invention, for general technical personnel of this field, on the premise of not giving creative labor, other figures can be obtained according to the existing figures.

DETAILED DESCRIPTION OF THE INVENTION

With the figures shown in this invention, a clear and complete description of this technical proposal is as below. The described embodiments are only a part of this invention, not all the embodiments. Based on the embodiments of this invention, all the other embodiments obtained by general technical personnel of this field are within the scope of this invention.

Figure 1:
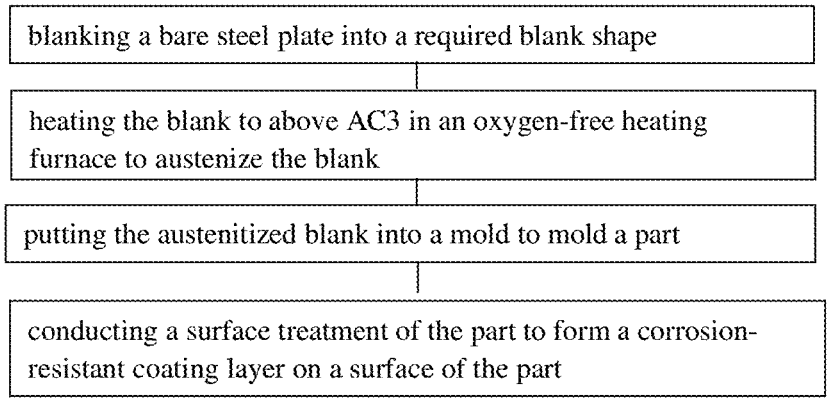
FIG. 1 is a flowchart of a method for manufacturing corrosion-resistant hot-stamping part in an embodiment of this invention.

Shown in FIG. 1, an embodiment of this invention provides a method for manufacturing a corrosion-resistant hot-stamping part, including the following steps:

Firstly, blank a 22MnB5 bare steel plate into a required shape, a specific blanking method includes cold stamping and laser cutting. The bare steel plate can be generally understood as steel plate without coating on the surface.

Then heating the blank to above AC3 heating the blank to above AC3 in an oxygen-free heating furnace) in an oxygen-free heating furnace to austenize the blank. The maximum temperature of the blank in oxygen-free furnace is from 860° C. to 1000° C., the blank in the oxygen-free heating furnace is heat to 880° C. to 950° C. Specifically, put the blanking blank into the oxygen-free furnace to be heated to an austenitic state and heat preserved to so that austenite in the blank is homogenized. The oxygen-free furnace is an inert gas protection furnace or vacuum heating furnace. The vacuum degree of vacuum furnace is between 0.1-500 Pa. To be better, the vacuum degree of vacuum furnace is between 0.1-100 Pa. Specifically, after the furnace door closed, start vacuum pump to vacuumize the furnace for 40-120 s, make the vacuum degree inside of the furnace 0.1-100 Pa, then use 99.999% nitrogen gas inflate the vacuum furnace which makes the inside of vacuum furnace to achieve one atmospheric pressure. Then electrify the heating components inside the furnace to heat the blank. During heating the blanking, in order to shorten the heating time, heat the surface of heating components to 1200° C. to 2000° C. After the temperature of the blank reaches austenitizing temperature, the temperature of the surface of the heating element is lowered, and the blank is subjected to heat preservation to homogenize the austenite. According to the thickness of different blanks, heating and thermal insulation time is 60-300 s. Using vacuum furnace to heat the blank into a high temperature state, so that the oxidation phenomenon of the blank can be reduced to a great extent. Therefore, the surface quality of the part after forming is excellent, the shot blasting process can be cancelled, and the surface of the heated part is almost free of residual oxide, the pickling time before the part electroplating is greatly reduced, and the risk of hydrogen embrittlement in the electroplating process of the part is greatly reduced.

Then use an end picker to pick up the austenitized blank and place into a mold quickly to form a part. Specifically, a time for transferring the blank from heating furnace to the mold is 5-10 s, reducing time of the high temperature blank exposing to the air, avoiding the high temperature blank oxidation as well as the the temperature of the high-temperature blank is also prevented from being greatly reduced. In this embodimentation case, the forming method is hot-stamping, the temperature of blank is 880° C. to 950° C. while the blank is picked up from the furnace, the temperature of blank start to forming in the mold is 650° C. to 850° C., and excellent forming performance of the steel plate is facilitated. The mold is provided with a water cooling system to make the part cooling at a speed not lower than 30° C./s during the molding process for a better mechanical property of the part.

Then, conduct a surface treatment to form a corrosion-resistant coating layer on the part surface. Specifically, the surface treatment includes electroplating, the corrosion-resistant layer includes electroplating layer. More specifically, the corrosion-resistant layer includes Zn coating, Zn—Fe alloy coating, Zn—Al alloy coating and Zn—Ni alloy coating. Pure zinc has the function of sacrificial anode protection, but corrosion rate is high. When the zinc content is between 3%-10%, Zn—Al alloy coating has higher corrosion-resistant performance, the higher the aluminum content, the better the corrosion-resistant, but when the mass percent of aluminum content is between 15%-25%, the corrosion-resistant performance Zn—Al alloy coating gets degraded. Therefore, it's preferable the mass percent of aluminum content between 3%-10% in the Zn—Al alloy coating mentioned. Compared to the pure zinc coating, the zinc-iron alloy containing a small amount of iron is improved by several times. When the mass percent of Fe content is between 10%-18%, the adhesion performance between Zn—Fe alloy coating and steel plate is the best. It's not easy to get peeling or cracking. For the part after forming, when the Fe content in Zn—Fe alloy coating is 0.3%-0.6%, the part can also get 5 times higher corrosion-resistant performance than pure zinc coating. Therefore, it's preferable the Fe content in Zn—Fe alloy coating layer less than 1% or 10-20%. In addition, the Zn—Fe alloy coated part has Fe element, so the welding performance in better during the following welding process. After passivation, alloy coating with nickel content <10%(mass percent) has 3-5 times higher corrosion-resistant performance than zinc coating. Zn—Ni alloy coating with nickel 10%-15% (mass percent) content has 6-10 times higher corrosion-resistant performance than zinc coating. The Zn—Ni alloy coating has moderate pore which is good for dehydrogen process and the coating layer also has lower hydrogen embrittlement property; and after the electrogalvanizing nickel alloy is resistant to neutral salt mist time exceeding 720 h, the electrophoretic process can be cancelled. Therefore, it's preferable the mass percent of nickel content is 5%-15% in the Zn—Ni alloy coating layer.

Furthermore, ultra-high strength steel has hydrogen embrittlement susceptibility, to reduce the risk of hydrogen embrittlement during plating process, ultrasonic cleaning or weak acid cleaning process for 5-10 s is adopted before plating. In addition, adopt low hydrogen embrittlement plating process, according to the coating layer thickness requirement, first using 5-10 A/dm$^2$ of the current density for 0.5-2 min to pulse plating for forming a dense thin coating layer which can prevent hydrogen atom gets into steel base material, and then the part is electroplated with a current density of 1-3 A/dm 2 for 5-15 min, so that the surface of the part forms the electrogalvanized layer with the required thickness. After the part is electroplated, the part is heated to between 140° C.-200° C., and the part is subjected to heat preservation for 10-30 minutes at this temperature to remove the part, thereby improving the mechanical property of the part.

Furthermore, between step" putting the austenitized blank into a mold to mold a part" and step" conducting a surface treatment of the part to form a corrosion-resistant coating layer on a surface of the part, there's a step: laser trimming or hole-cutting the part. Compared to proceeding plating before trimming and hole cutting, plating after trimming and hole cutting process can save plating solution. what's more, the trimming and hole cutting area can also be plated, and the corrosion resistance is improved due to the protection of the electroplating layer at the trimming edge or cutting hole of the part.

The following 4 cases specify above embodiments:

Case 1:

1. Using 22MnB5 bare steel plate having a thickness of 1.4 mm to blank to get a blank with required shape.

2. Putting the blank into a vacuum furnace, starting a vacuum pump to vacuumize the furnace for 80 s after the furnace door closed, making the vacuum degree inside the furnace reaches 100 Pa, then using 99.999% nitrogen gas inflate the vacuum furnace which makes the inside of vacuum furnace to achieve one atmospheric pressure, then starting the heating components in the furnace to heat the blank. Heating the blank to 930° C. and hold for thermal insulation, the heating and thermal insulation time of the blank in vacuum furnace is total of 140 s for this process. After the thermal insulation time of the blank is finished, the furnace door is opened for fetching.

3. Quickly putting the austenitized blank into the mold with water cooling for thermoforming to form part;

4. Laser trimming the part;

5. Adopting acid zinc plating process for electroplating the part. Wherein, before electroplating, using ultrasonic waves to clean the part for 20 s, pickling for 5-10 s using 5-10% hydrochloric acid, the zinc electroplating process is acid zinc electroplating which adopt electroplating with acidic potassium chloride with high cathodic polarization efficiency. Each composition and its content of the plating solution: 200 g/L potassium chloride, Zinc ion 32 g/L, boric acid 27 g/L, bath temperature 26° C., pH value 4.5, using 8 A/dm$^2$ high current to pulse plating for 30 s, then use a low current of 2 A/dm$^2$conduct normal electroplating for 8 min, finally forming a 5 um coating layer.

6. Conducting the dehydrogen process to the electroplated part, specifically, heating the electroplated part to 160° C. and hold the part at this temperature for 20 min.

Case 2:

1. Using a 22MnB5 bare steel plate have a thickness of 1.4 mm to blanking to get a blank with required shape.

2. Putting the blank into a vacuum furnace, starting a vacuum pump to vacuumize the furnace for 40 s after the furnace door closed, making the vacuum degree inside furnace reaches 10 Pa, then using 99.999% nitrogen gas inflate the vacuum furnace which makes the inside of vacuum furnace to achieve one atmospheric pressure. Then starting the heating components in the furnace to heat the blank. Heating the blank to 930° C. and hold for thermal insulation, the heating and thermal insulation time of the blank in vacuum furnace is total of 140 s. After the thermal insulation time of the blank is finished, the furnace door is opened for fetching.

3. putting the austenitized blank into the mold with water cooling for thermoforming to form part;

4. Laser trimming the part;

5. Adopt alkaline zinc electroplating process for electroplating the part. Before electroplating, use hydrochloric acid with 8% mass concentration to clean the part for 10 s. The zinc electroplating process is alkaline electroplating. Each composition and its content of the plating solution: Sodium hydroxide 130 g/L, zinc ion concentration 12 g/L, PH value 9, using 6 A/dm high current to pulse plating for 60 s, Then use a low current of 2 A/dm$^2$conduct normal electroplating for 8 min, finally forming a 8 um coating layer.

6. Conducting the dehydrogen process to the electroplated part, specifically, heating the electroplated part to 190° C. and hold the part at this temperature for 15 min Case 3:

1. Using a 22MnB5 bare steel plate have a thickness of 1.4 mm to blanking to get a blank with required shape.

2. Putting the blank into a vacuum furnace, starting a vacuum pump to vacuumize the furnace for 90 s after the furnace door closed, making the vacuum degree inside the furnace reaches 50 Pa, then using 99.999% nitrogen gas inflate the vacuum furnace which makes inside of the vacuum furnace to achieve one atmospheric pressure. Then starting the heating components in the furnace to heat the blank. Heating the blank to 930° C. and hold for thermal insulation, the heating and thermal insulation of the blank in vacuum furnace is total 140 s. After the thermal insulation time of the blank is finished, the furnace door is opened for fetching.

3. Quickly putting the austenitized blank into the mold with water cooling for thermoforming to form part;

4. Laser trimming the part;

5. Adopting alkaline Zn—Fe electroplating process for electroplating the part. Before electroplating, ultrasonic clean part for 20 s. Each composition and its content of the plating solution: Zinc sulfate 80 g/L, ferric chloride 7 g/L, sodium dihydrogen phosphate 36 g/L, potassium pyrophosphate 25 g/L, PH 8.5, current density 2.1 A/dm$^2$, coating thickness 6 um; The mass fraction of Fe in the coating layer is 0.3-0.6%.

6. Conducting the dehydrogen process to the electroplated part, specifically, heat the electroplated part to 170° C. and hold the part at this temperature for 25 min Comparison Case 4:

A bare steel plate, a hot-dip galvanized plate, a Al—Si coating plate are respectively heated for 4 min in a conventional atmosphere roll bottom heating furnace at a temperature of 930° C. and make the blank austenitized, then conduct hot-stamping process.

Conduct metallography test, 720 h salt spray test and scratch test on part in case 1-3 and comparison case 4, and mechanical performance test and hydrogen content test comparison are carried out.

Figures 2, 3, 4:
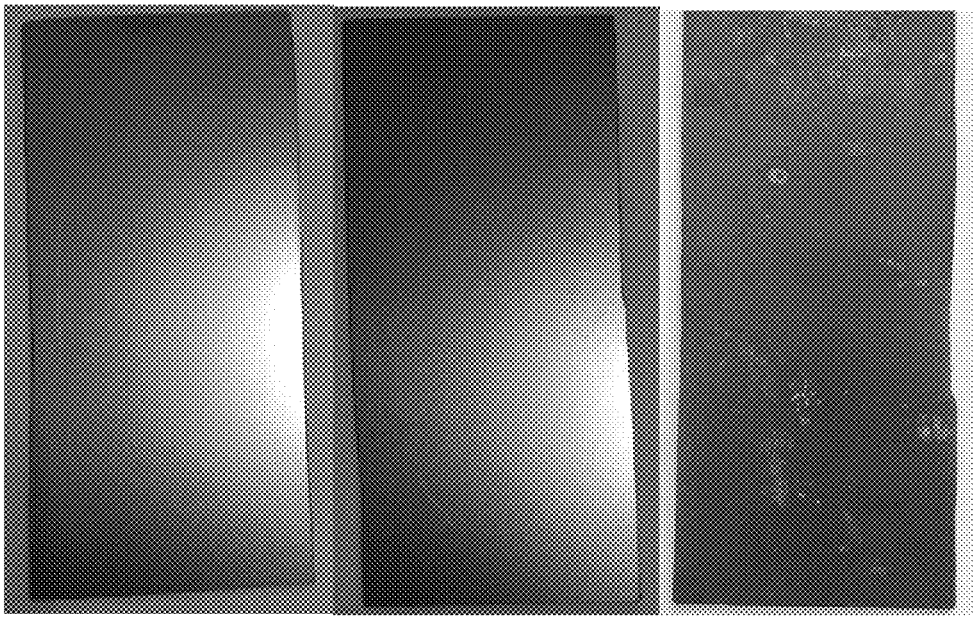
FIG. 2 is a surface oxidation effect diagram of a bare steel plate under a vacuum degree of 10 Pa after heating.
FIG. 3 is a surface oxidation effect diagram of a bare steel plate under the vacuum degree of 100 Pa after heating.
FIG. 4 is a surface oxidation effect diagram of a bare steel plate under one atmospheric pressure after heating.
Figure 5:
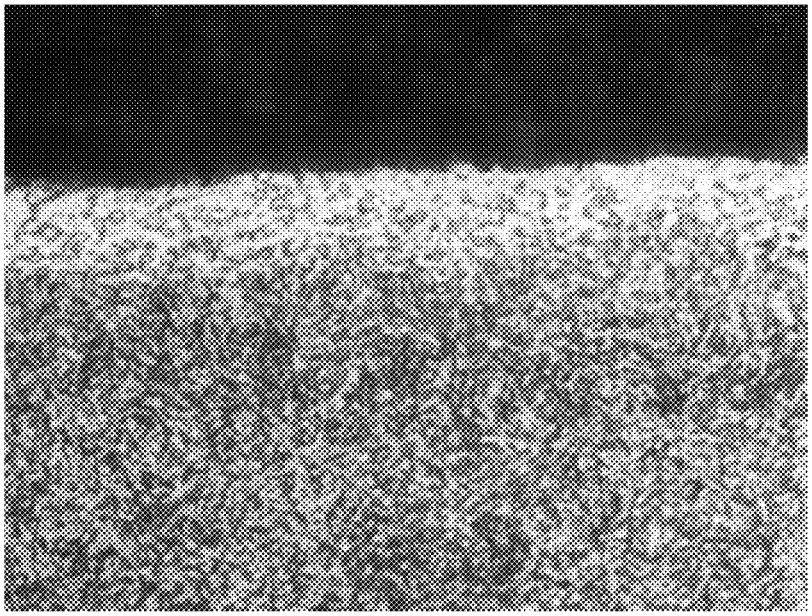
FIG. 5 is a metallograph of zinc coating layer of a part in case 1 of this invention.
Figure 6:
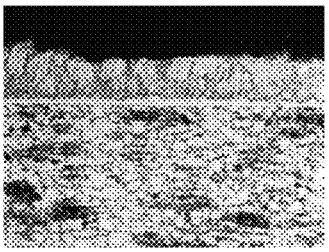
FIG. 6 is a coating metallograph of a Al—Si coated plate in comparison case 4 of this invention.
Figure 7:
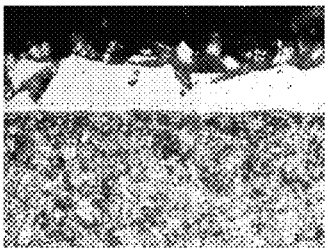
FIG. 7 is a coating metallograph of the Al—Si coated plate after heating in comparison case 4 of this invention.
Figure 8:
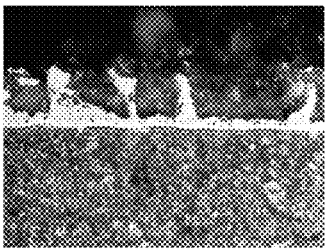
FIG. 8 is a coating metallograph of the Al—Si coated plate after hot stamping in comparison case 4 of this invention.
Figure 9:
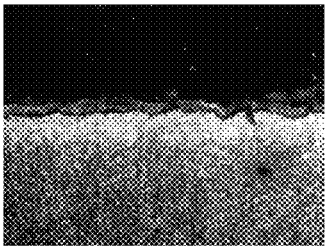
FIG. 9 is a coating metallograph of a hot-dip galvanized plate in comparison case 4 of this invention.
Figure 10:
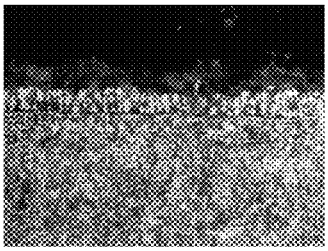
FIG. 10 is a coating metallograph of the hot-dip galvanized plate after heating in comparison case 4 of this invention.
Figure 11:
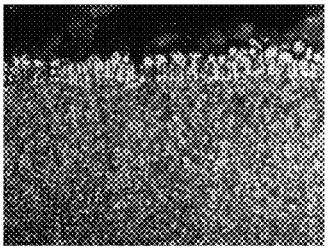
FIG. 11 is a coating metallograph of the hot-dip galvanized plate after hot stamping in comparison case 4 of this invention.
Figure 12:
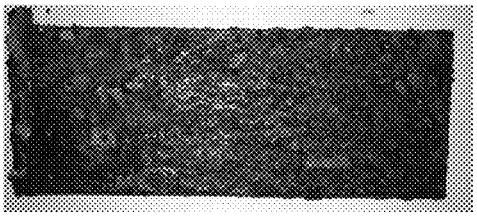
FIG. 12 is a corrosion photo of the hot-stamped bare steel plate after 720 h weight loss salt spray test in comparison case 4 of this invention.
Figure 13:
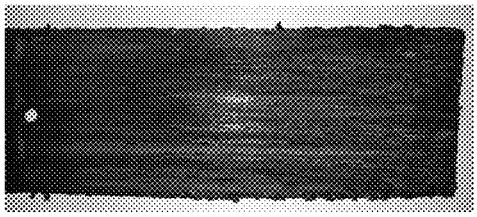
FIG. 13 is a corrosion photo of the hot-stamped Al—Si coated plate after 720 h weight loss salt spray test in comparison case 4 of this invention.
Figure 14:
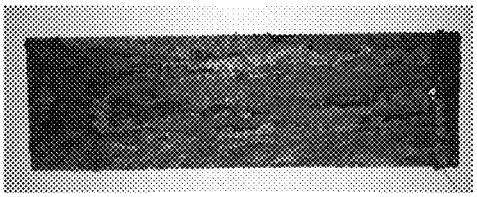
FIG. 14 is a corrosion photo of the hot-stamped and hot-dip galvanized plate after 720 h weight loss salt spray test in comparison case 4 of this invention.
Figure 15:
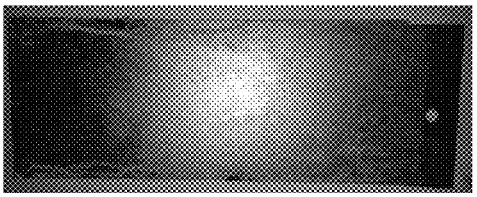
FIG. 15 is a corrosion photo of the part after 720 h weight loss salt spray test in case 1 of this invention.
Figure 16:
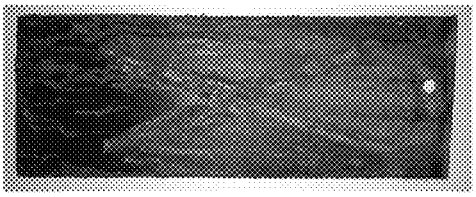
FIG. 16 is a scratch corrosion photo of an electrophoretic coating layer of the hot-stamped bare steel plate after 720 h salt spray test in comparison case 4 of this invention.
Figure 17:
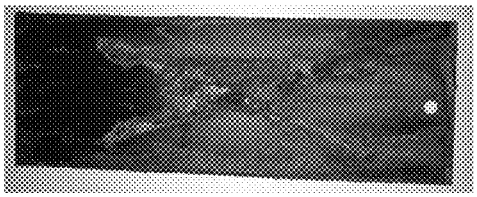
FIG. 17 is a scratch corrosion photo of an electrophoretic coating layer of the hot-stamped Al—Si coated plate after 720 h salt spray test in comparison case 4 of this invention.
Figure 18:
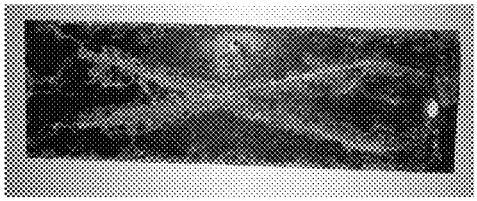
FIG. 18 is a scratch corrosion photo of an electrophoretic coating layer of the hot-stamped and hot-dip galvanized plate after 720 h salt spray test in comparison case 4 of this invention.
Figure 19:
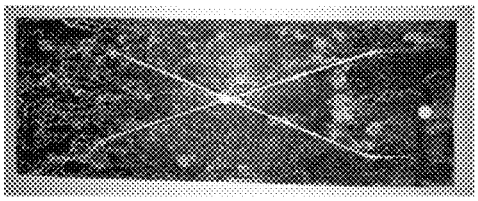
FIG. 19 is a scratch corrosion photo of an electrophoretic coating layer of the part after 720 h salt spray test in case 1 of this invention.
Figure 20:
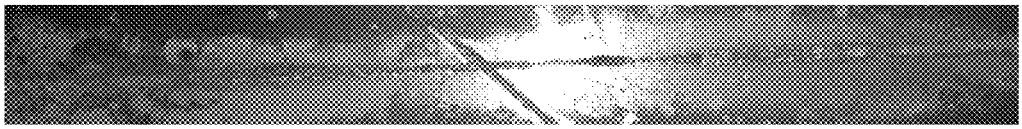
FIG. 20 is a scratch corrosion photo of a substrate after electrophoresis of the hot-stamped bare steel plate after 720 h salt spray test in comparison case 4 of this invention.
Figure 21:
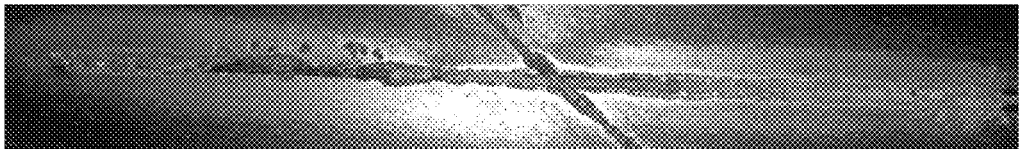
FIG. 21 is a scratch corrosion photo of a substrate after electrophoresis of the hot-stamped Al—Si coated plate after 720 h salt spray test in comparison case 4 of this invention.
Figure 22:
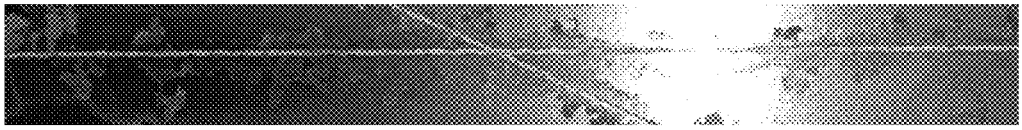
FIG. 22 is a scratch corrosion photo of a substrate after electrophoresis of the hot-stamped and hot-dip galvanized plate after 720 h salt spray test in comparison case 4 of this invention.
Figure 23:
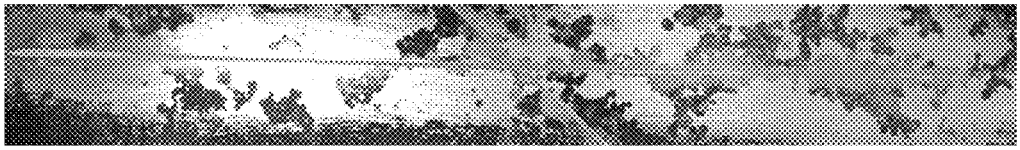
FIG. 23 is a scratch corrosion photo of a substrate after electrophoresis of the part after 720 h salt spray test in case 1 of this invention.

Shown in FIG. 2-4, heat blanks under different vacuum degree, the oxidation results of bare steel plate is: no oxidation under 10 Pa-100 Pa vacuum degree, severe oxidation under normal atmosphere.

FIGS. 5-11 shows the metallography of coating cross section of different coating steel plates after heating and forming process. The coating layer is dense on the Al—Si coating plate and hot galvanizing plate in comparison case 4, but severe damaged after heating and hot-stamping. In cases 1-3, the coating density of bare steel plate is not damaged when plating after heating and hot-stamping.

Based on FIG. 12-23 and table 1, after 720 h salt spray test, the severest corrosion is on the part that made of bare steel plate in comparison case 4. Hot galvanizing plate corrosion is less. Corrosion rate of Al—Si coating plate is 1.38×10−4 g/mm$^2$, the corrosion rate of bare steel plate in case 1-3 is as low as 5.74×10$^{-6}$ g mm which is 20 times higher corrosion-resistant than Al—Si coating part in comparison case 4.

The scratch test shows that the width of scratches on each part is roughly 1 mm before hot-stamping. After 720 h salt spray, the width of base material corrosion of bare steel plate and Al—Si coating plate in comparison case 4 is 1.54 mm and 3.22 mm. The galvanized part in case1 has no corrosion on base material due to the sacrifice anode protection.

TABLE 2-continued

Mechanical test and hydrogen test results

| NO. | Tensile strength (Rm) (MPa) | Yield strength (Rp0.2) (MPa) | Elongation (A) (%) | Hydrogen content (ppm) |
|---|---|---|---|---|
| Bare steel plate in comparison case 4 | 1405.123 | 1050.68 | 5.8 | 2.10 |
| Al- Si coating plate in comparison case 4 | 1453.125 | 1145.927 | 6.200 | 3.32 |
| Galvanizing plate not dehydrogenate | 1462.183 | 1147.762 | 6.200 | 3.51 |
| Galvanizing plate in case 1 | 1479.053 | 1226.599 | 7.460 | 3.36 |

TABLE 1

Salt spray test results on Case 1 and Comparison case 4

| Plate | Material weight (g) | 720 h corrosion weight (g) | Weight loss (g) | Weight loss percent | area mm2 | Area loss (g/mm2) | Scratch width after hot forming and e-coating (mm) | Corrosion width of coating layer after 720hsalt spray(mm) | Corrosion width of base material after 720hsalt spray (mm) |
|---|---|---|---|---|---|---|---|---|---|
| Bare steel plate in comparison case 4 | 185.26 | 148.78 | 36.48 | 19.69% | 19006 | 1.9E−3 | 1.20 | 8.51 | 1.54 |
| Al-Si coating plate in comparison case 4 | 149.69 | 147.15 | 2.54 | 1.69% | 18400 | 1.38E−4 | 1.479 | 9.42 | 3.22 |
| Hot galvanizing plate in comparison case 4 | 241.73 | 237.57 | 4.16 | 1.72% | 10504 | 3.96E−4 | 0.938 | 6.67 | 0 |
| Case 1 se 1 | 235.85 | 235.74 | 0.11 | 0.4% | 19173 | 5.74E−6 | 0.957 | 6.08 | 0 |

Table 2 is the results for mechanical test and hydrogen test of the hot-stamping part in case 1 and comparison case 4. It shows that the bare plate after hot-stamping and galvanizing and the bare plate after hot-stamping, galvanizing and dehydrogen both can meet the tensile strength, yield strength and elongation standard for hot forming production. And the hydrogen content in bare plate after hot-stamping is almost on the same level with it in Al—Si coating plate.

TABLE 2

Mechanical test and hydrogen test results

| NO. | Tensile strength (Rm) (MPa) | Yield strength (Rp0.2) (MPa) | Elongation (A) (%) | Hydrogen content (ppm) |
|---|---|---|---|---|
| Hot forming production standard | 1300-1650 | 950-1250 | ≥5.0 | — |

This invention also provides a manufacturing device for corrosion-resistant hot-stamping part using the above mentioned method. It includes a blanking mechanism, a heating mechanism, a molding mechanism and a surface treatment mechanism:

The blanking mechanism is used to blank the bare steel plate into the required blank shape.

The heating mechanism is used to heat the blank after blanking.

The molding mechanism is used to mold the blank after the heating into the part.

The surface treatment mechanism is used to conduct surface treatment of the part to form corrosion-resistant coating layer on the part surface.

A specific embodiment is applied in the invention to describe the principle and embodiment of the invention. The description of this embodiment is only used to help understand the method of the invention and its core idea; At the same time, for the general technician in the field, according to the idea of the invention, there will be some changes in the specific way of embodiment and the scope of application. To sum up, the description of content should not be construed as a limitation of this invention.

What is claimed is:

1. A method for manufacturing a corrosion-resistant hot-stamping part without shot blasting, comprising:

blanking a bare steel plate into a required blank shape, heating the blank to above AC3 in an oxygen-free heating furnace to austenitize the blank;

wherein the oxygen-free heating furnace is a vacuum heating furnace and a vacuum degree of the vacuum heating furnace is 50-500 Pa;

putting the austenitized blank into a mold to mold a part;

conducting an ultrasonic cleaning or pickling on the part, then using an electroplating process to form a corrosion-resistant coating layer on a surface of the part; and conducting a dehydrogenation treatment;

wherein the dehydrogenation treatment comprises heating the part to 140° C.-190° C. and insulating the part at the temperature for 10-30 min;

wherein the electroplating process comprises firstly using a current density of 5-10 A/dm$^2$ for 0.5-2 min to strike plating the part; and using a current density of 1-3 A/dm$^2$ for 1-15 min to electroplating the part;

wherein a tensile strength of the part after treated reaches 1300-1650 Mpa wherein the step heating the blank to above AC3 in an oxygen-free heating furnace to austenize the blank, wherein the oxygen-free heating furnace is a vacuum heating furnace and a vacuum degree of the vacuum heating furnace is 50-500 Pa comprises:

putting the blanking blank into an oxygen-free furnace;

starting vacuum pump to vacuumize the furnace to make the vacuum degree inside of the furnace 50-500 Pa;

then using nitrogen gas inflate the vacuum furnace which makes the inside of vacuum furnace to achieve one atmospheric pressure; and heating the blank to above AC3 to austenize the blank;

wherein the oxygen-free heating furnace is a vacuum heating furnace and a vacuum degree of the vacuum heating furnace is 50-500 Pa.

2. The method for manufacturing the corrosion-resistant hot-stamping part according to claim 1, wherein an oxygen content in the vacuum heating furnace when heating is below 0.5%.

3. The method for manufacturing the corrosion-resistant hot-stamping part according to claim 1, wherein the vacuum degree of the vacuum heating furnace is 50-100 Pa.

4. The method for manufacturing the corrosion-resistant hot-stamping part according to claim 1, wherein a time for heating the blank and a time for insulating the part by the oxygen-free heating furnace is 60-300 s in total.

5. The method for manufacturing the corrosion-resistant hot-stamping part according to claim 1, wherein the blank in the oxygen-free heating furnace is heated to 880° C. -950° C.

6. The method for manufacturing the corrosion-resistant hot-stamping part according to claim 1, wherein a time for transferring the blank after heating from the oxygen-free heating furnace to the mold is 5-10 s.

7. The method for manufacturing the corrosion-resistant hot-stamping part according to claim 1, wherein a temperature for the blank in the mold starting to be molded is 650° C. -850° C.

8. The method for manufacturing the corrosion-resistant hot-stamping part according to claim 1, wherein the mold has a water cooling system, and the water cooling system makes the blank cooling at a speed of not less than 30° C./s during the molding.

9. The method for manufacturing the corrosion-resistant hot-stamping part according to claim 1, wherein the corrosion-resistance coating layer comprises a Zn coating, a Zn—Fe alloy coating, a Zn—Al alloy coating, or a Zn—Ni alloy coating.

10. The method for manufacturing the corrosion-resistant hot-stamping part according to claim 1, wherein a heating speed in the vacuum heating furnace is 20° C./s-50° C./s.

11. The method for manufacturing the corrosion-resistant hot-stamping part according to claim 1, wherein a time for pickling the part is 5 s-15 s.

12. The method for manufacturing the corrosion-resistant hot-stamping part according to claim 11, wherein an auxiliary anodizing or a pictographic anodizing is used when electroplating.

13. The method for manufacturing the corrosion-resistant hot-stamping part according to claim 1, wherein between the step "putting the austenitized blank into a mold to mold a part" and the step "conducting an ultrasonic cleaning or pickling on the part", further comprising laser trimming or hole- cutting the part.

* * * * *